US005984443A

United States Patent [19]

Desie et al.

[11] Patent Number: 5,984,443

[45] **Date of Patent: *Nov. 16, 1999**

[54] DIRECT ELECTROSTATIC PRINTING DEVICE WHICH USES A GAS STREAM TO PROVIDE A CLOUD OF TONER PARTICLES

[75] Inventors: Guido Desie, Herent; Ludo Joly, Hove; Luc Van Aken, Kuringen; Jacques Leonard, Antwerpen; Frans Backaljauw, Zwijndrecht; André Van Geyte, Sint-Katelijne-Waver, all of Belgium

[73] Assignee: Agfa-Gevaert, Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/713,183

[22] Filed: Sep. 12, 1996

Related U.S. Application Data

[60] Provisional application No. 60/006,004, Oct. 26, 1995.

[30] Foreign Application Priority Data

Sep. 14, 1995 [EP] European Pat. Off. ..... 95202487

[51] Int. Cl.[6] ..... B41J 2/06

[52] U.S. Cl. ..... 344/55

[58] Field of Search ..... 347/55, 141, 158, 347/21

[56] References Cited

U.S. PATENT DOCUMENTS 4,117,778 10/1978 Watanabe et al. ..... 347/21
4,154,195 5/1979 Mugrauer ..... 118/659
4,777,106 10/1988 Fotland et al. ..... 430/120

FOREIGN PATENT DOCUMENTS

0464741 A3 1/1992 European Pat. Off. .
62-111757 5/1987 Japan ..... 347/55

OTHER PUBLICATIONS

Patent Abstracts of Japan, vol. 018, No. 405 (P–1778), Jul. 28, 1994 and JP–A–06 118740 (Fuji Xerox Co., Ltd.), Apr. 28, 1994.

*Primary Examiner*—Benjamin R. Fuller
*Assistant Examiner*—C Dickens
*Attorney, Agent, or Firm*—Baker & Botts, L.L.P.

[57] ABSTRACT

A DEP device is provided that comprises a back electrode (105), a printhead structure (106), an array of printing apertures (107) in the printhead structure (106) through which a particle flow can be electrically modulated by a control electrode **(106*a*), a toner delivery means (101), presenting a cloud (100) of dry toner particles in the vicinity of the apertures (107), characterized in that the toner cloud (100) is formed in the vicinity of the apertures (107)** by means of a gas stream. The toner cloud is formed by detaching toner particles from a charged toner conveyer by the gas stream, or by forming a fluidized bed of toner particles.

14 Claims, 3 Drawing Sheets

DIRECT ELECTROSTATIC PRINTING DEVICE WHICH USES A GAS STREAM TO PROVIDE A CLOUD OF TONER PARTICLES

This application claims benefit of provisional application Ser. No. 60/006,004 filed Oct. 26, 1995.

DESCRIPTION

1. Field of the Invention

This invention relates to the process of electrostatic printing and more particularly to Direct Electrostatic Printing (DEP). In DEP electrostatic printing is performed directly on a substrate by means of electronically addressable printheads.

2. Background of the Invention

In DEP (Direct Electrostatic Printing) the toner or developing material is deposited directly in an imagewise way on a substrate, the latter not bearing any imagewise latent electrostatic image. The substrate can be an intermediate, in case it is preferred to transfer said formed image on another substrate (e.g. aluminum, etc.), but it is preferentially the final receptor, thus offering a possibility to create directly the image on the final receptor, e.g. plain paper, transparency, etc . . . . after a final fusing step. This makes the method different from classical electrography, in which a latent electrostatic image on a charge retentive surface is developed by a suitable material to make the latent image visible and in which either the powder image is fused directly to said charge rententive surface, which then results in a direct electrographic print, or in which the powder image is subsequently transferred to the final substrate and then fused to that medium, the latter process resulting in a indirect electrographic print. The final substrate can be different materials, such as a transparent medium, opaque polymeric films, paper, etc . . . .

DEP is also markedly different from electrophotography in which an additional step and additional member is introduced to create the latent electrostatic image, more specifically, a photoconductor is used and a charging/exposure cycle is necessary.

A DEP device is disclosed in U.S. Pat. No. 3,689,935. This document discloses an electrostatic line printer comprising a multilayered particle modulator or printhead comprising a layer of insulating material, a continuous layer of conductive material on one side of the layer of the insulating material and a segmented layer of conductive material on the other side of the layer of the insulating material. The printhead comprises also at least one row of apertures. Each segment of the segmented layer of conductive material is formed around a portion of an aperture and is isolated from each other segment of the segmented conductive layer. Selected potentials are applied to each of the segments of the segmented conductive layer while a fixed potential is applied to the continuous conductive layer. An overall applied field projects charged particles through a row of apertures of the particle modulator (printhead) and the intensity of the particle stream is modulated according to the pattern of potentials applied to the segments of the segmented conductive layer. The modulated stream of charged particles impinges upon a print-receiving medium interposed in the modulated particle stream and translated in a direction relative to the particle modulator (printhead) to provide a line-by-line scan printing. The segmented electrode is called the control electrode and the continuous electrode is called the shield electrode. The shield electrode faces, e.g., the toner supply and the control electrode faces the image recording member. A DC field is applied between the printhead and a backing electrode so as to attract the toner to the imaging receiving member that is placed between the printhead and the backing electrode.

In electrostatic printing, following two problems need to be solved before high quality printing becomes possible:

presenting an uniform cloud of toning particles to the printhead.

supplying sufficient charged toning particles to the printhead structure, without scattering them or without contaminating the printhead structure and the engine environment.

In GB 2,108,432 different measures are disclosed to present an uniform cloud of toner particles to the printhead. Therefore a conveying member is provided on which a layer of toner particles is deposited and an AC voltage is applied between the toner conveying member and the continuous layer of conductive material on the printhead structure. Due to this AC voltage the toner particles "jump" between the toner conveying member and the surface of the printhead facing said toner conveying member, forming a "toner-cloud". The AC-voltage is adjusted such as to allow the toner particles to reach the printhead structure, thus enabling the overall DC voltage laid between the printhead structure and the substrate bearing member to extract said toner particles after modulation from said powder cloud. The overall DC voltage propels the toner particles, after said modulation, onto the image receiving member interposed between the printhead and a backing electrode.

In DE-OS 3,411,948 an apparatus is disclosed wherein the toning particles are presented to the printhead structure in layer form on a conveying member. Said conveying member has a special design and AC/DC fields are used to realise jumping transport along said printhead structure. Also in this document the quality of the "toner-cloud" is addressed to make the process easier.

In EP-A 266 960 a toner delivery system is disclosed in which a monolayer of toner is deposited on the surface of the toner conveying means using a multi-component developer (carrier/toner) and a conventional magnetic brush. The use of a multi-component developer results in a favourable charge distribution in the toner and hence in a reduction of the contamination rate of the printhead. In U.S. Pat. No. 5,099,271 a DEP device is disclosed wherein the toner cloud is mechanically produced, the toner cloud is produced by using a brush with polymeric elastic hairs that scratch over a scraper blade.

In EP-A 675 417, U.S. Pat. No. 5,327,169 and Japanese Laid Open Application JP-A 60/263962 it is disclosed to present the toner cloud to the printhead structure directly from a magnetic brush.

The modifications disclosed in the references cited above do solve, at least partially, the problems encountered in practising DEP, but the printing speed of the devices is still strongly dependent on the amount of toner (density of the toner cloud) that can be presented to the printhead structure. There have been proposals to improve the density of the toner cloud in order to be able to increase the printing speed. In e.g. European Application 95200834 filed on Apr. 3, 1995 it is disclosed to adapt, in a DEP device extracting the toner cloud directly from a magnetic brush, the speed of the magnetic brush to the travelling speed of the substrate on which is printed. In doing so both the printing speed for the same achievable maximum density and the evenness of the printing could be enhanced. In European Application 95201048, filed on Apr. 25, 1995 the same benefits are disclosed in a DEP device where the toner cloud is not directly generated from a magnetic brush, but from a charged toner conveyer (CTC) when the speed of the CTC is adapted to the travelling speed of the substrate on which is printed. The printing speed can also be enhanced in systems, where the toner cloud is produced by a brush with polymeric elastic hairs, when the rotating speed of said brush is well adjusted, as is described in U.S. Pat. No. 5,386,255. Although these solutions do give good printing at high printing speed, the moving speed of the magnetic brush or the CTC becomes rather high, and does thus increase the mechanical stresses on said toner cloud producing modules.

In EP-A 464 741 a DEP device comprising a combined toner charging and delivery means, wherein the toner particles are extracted from a fluidized bed and then moved at a controlled velocity through an annular member by an air stream. By passing through this annular member the toner particles are charged and brought in the vicinity of the printing apertures in a printhead structure. In this DEP device the moving parts are minimized, but the construction of the combined toner charging and delivery means is quite complicated, and the velocity of the air stream has to be controlled carefully since otherwise the toner charging can almost not be controlled.

There is thus still a need to have means for presenting a dense toner cloud to the printhead structure, so that the step of toner cloud production is no longer the step that limits the printing speed.

OBJECTS AND SUMMARY OF THE INVENTION

It is an object of the invention to provide a DEP (Direct Electrostatic Printing Device) wherein a dense toner cloud is presented to the printhead structure.

It is a further object of the invention to provide a DEP device in which the printing speed is less dependent on the rate with which the toner cloud can be presented.

It is still a further object of the invention to provide a DEP that enables high speed printing without the need for fast moving means for supplying toner at the printing apertures and thus with minimal mechanical stresses on the components.

It is a still further object of the invention to provide a DEP device wherein for the production of a toner mist (toner cloud) less mechanical moving parts are necessary.

Further objects and advantage of the method will become apparent from the detailed description hereinafter.

The objects of the invention are realised by providing a DEP device that comprises a printhead structure (106), an array of printing apertures (107) in said printhead structure (106) through which a particle flow can be electrically modulated by a control electrode (106*a*), a toner delivery means (101), presenting a cloud (100) of dry toner particles in the vicinity of said apertures (107), characterised in that said toner cloud (100) is formed in the vicinity of said apertures (107) by means of a gas stream detaching said toner particles from said charged toner conveyer.

In a preferred embodiment said gas stream is a stream of air. In an other preferred embodiment said toner cloud (100) is presented under the form of a fluidized bed.

DETAILED DESCRIPTION OF THE INVENTION

Figure 1:
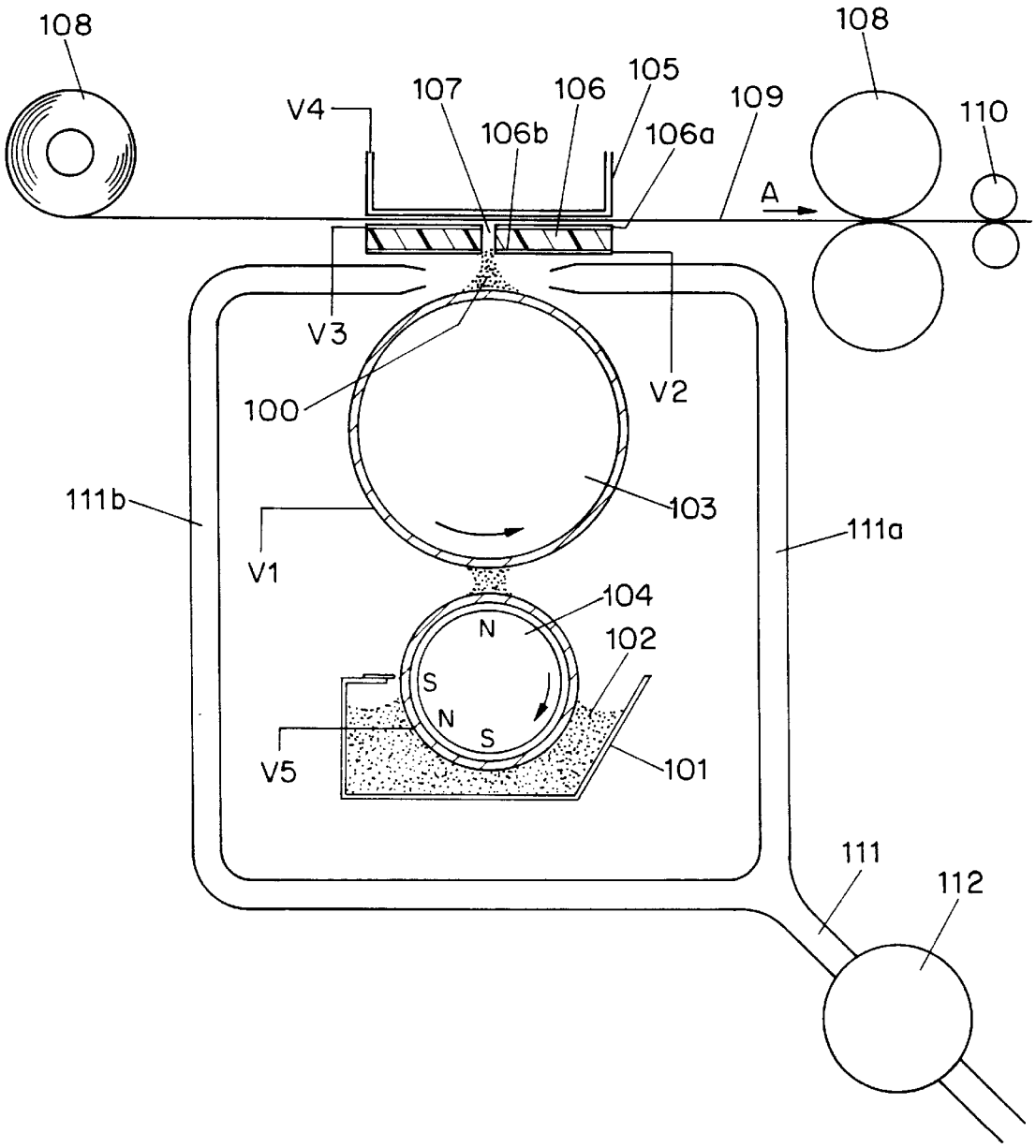
FIG. 1 shows a schematic illustration of a specific embodiment of a DEP device according to the present invention.

It has been found that a dense toner cloud could be presented to the apertures in the printhead structure of a DEP device by means of a gas stream, thus minimizing the moving parts in the DEP device. This gas stream brings the toner particles in a loose whirling cloud in the neighbourhood of the printing apertures. Although any gas can be used in said gas stream forming said loose whirling cloud of toner particles, it is preferred to use a stream of air. Several mechanical implementations of a DEP device, using a gas stream to produce the toner cloud are possible. In FIG. 1, an example of a possible implementation is shown (further on called EMBODIMENT 1). In this figure toner (102) is brought from a toner container (101) via a magnetic brush (104) on to a charged toner conveyer (103). In the specific case shown, the toner is part of a multi-component developer, comprising magnetic carrier particles and non-magnetic toner particles. The toner on the CTC (103) is subjected to two air streams coming from the outlets (111*a*) and (111*b*). The speed of streams of air and the amount of air can be independently adjusted for each outlet (111*a*) and (111*b*), by air controlling means (in the figure an air valve) (112). Due to the air streams the toner on the CTC whirls in the neighbourhood of the printing apertures (107) and can be attracted to the receiving substrate (109) that is transported, by transporting means (108) between the printhead structure (106), and a back electrode (105) in the direction of arrow A. The image is fixed to the substrate (109) by fixing means (110). It is also possible by appropriate timing means, installed on control means (112), to have either continuous or pulsating air streams. The pulsation of the air streams can be independently adjusted to the desired value. The pulsation of the gas streams from outlet (111*a*) and (111*b*) can be alternated, i.e. when gas is passed to the toner particles from outlet (111*a*), outlet (111*b*) is closed and vice-versa. Said gas (air) streams are preferably pulsated at a frequency between 10 and 200 Hz. The gas stream(s) has (have) a pressure of at least 1 $10^5$ Pa.

Printhead structure (106) shown in the first embodiment (FIG. 1) is made from a plastic insulating film, coated on both sides with a metallic film. The printhead structure (106) comprises one continuous electrode surface, hereinafter called "shield electrode" (106*b*) facing in the shown embodiment the toner delivering means and a complex addressable electrode structure, hereinafter called "control electrode" (106*a*) around printing apertures (107), facing, in the shown embodiment, the toner-receiving member in said DEP device. Said printing apertures (107) are arranged in an array structure for which the total number of rows can be chosen according to the field of application. The location and/or form of the shield electrode (106*b*) and the control electrode (106*a*) can, in other embodiments of a device for a DEP method using toner particles according to the present invention, be different from the location shown in FIG. 1. The invention can also be used in DEP devices comprising a printhead structure comprising only control electrodes (106*a*) and no shield electrode (106*b*). The invention can also be practised using a printhead structure where around every printing aperture (107), through an insulating material, one individual control electrode (106*a*) on one side of said insulating material and one individual shield electrode (106*b*) on the other side of said insulating material are present each single electrode of said individual control electrodes (106*a*) and each single electrode of said individual shield electrodes (106*b*) arranged around each aperture (107) are connected to each other via metallisation through said single aperture (107), forming a single printing electrode around each aperture (107).

The printhead structure used in the first embodiment can also be a so called matrix electrode as described in e.g. EP-B 390 847 and EP-B 476 030.

The back electrode (105) of a DEP device, according to the present invention, can be made as a planar electrode but can also be made to cooperate with the printhead structure, said back electrode being constructed from different styli or wires that are galvanically isolated and connected to a voltage source as disclosed in e.g. U.S. Pat. No. 4,568,955 and U.S. Pat. No. 4,733,256. The back electrode, cooperating with the printhead structure, can also comprise one or more flexible PCB's (Printed Circuit Board).

Between said printhead structure (106) and the charged toner conveyer (103) as well as between the control electrode around the apertures (107) and the back electrode (105) behind the toner receiving member (109) as well as on the single electrode surface or between the plural electrode surfaces of said printhead structure (106) different electrical fields are applied. In the specific embodiment of a device (EMBODIMENT 1), useful for a DEP method, according to the present invention, shown in FIG. 1, voltage V1 is applied to the sleeve of the charged toner conveyer (103), voltage V2 to the shield electrode (106*b*), voltages $\mathbf{V3}_0$ up to $\mathbf{V3}_n$ for the control electrode (106*a*). The value of V3 is selected, according to the modulation of the image forming signals, between the values $\mathbf{V3}_0$ and $\mathbf{V3}_n$, on a timebasis or grey-level basis. Voltage V4 is applied to the back electrode behind the toner receiving member. In other embodiments of the present invention multiple voltages $\mathbf{V2}_0$ to $\mathbf{V2}_n$ and/or $\mathbf{V4}_0$ to $\mathbf{V4}_n$ can be used. Voltage V5 is applied to the surface of the sleeve of the magnetic brush. EMBODIMENT 1 works in principle in exactly the same way, when instead of a multi-component developer, a magnetic toner is used (without the presence of carrier particles). When a magnetic toner is used CTC (103) is made magnetic and attracts directly magnetic toner from the toner container (101). It is also possible to use in a DEP device, according to EMBODIMENT 1 a non magnetic mono component toner that is applied to a CTC after charging of the toner by e.g. the scraping of the toner over a doctor blade. In this case the CTC does not attract the toner particles by magnetic forces, but by electrostatic forces.

Figure 2:
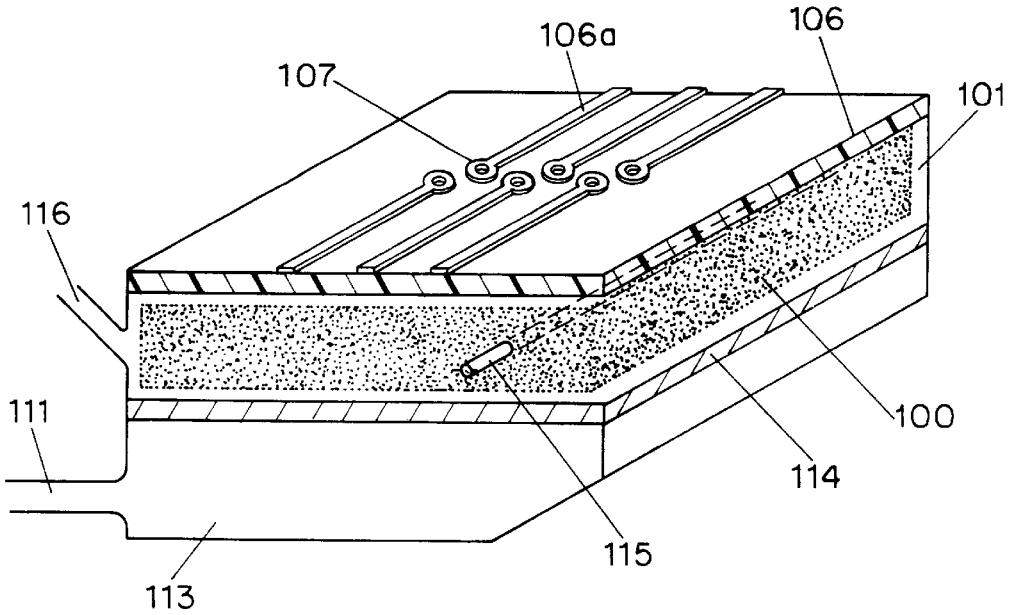
FIG. 2 shows a schematic illustration of a printhead structure and fluidized toner bed built together in one toner supply module.

In another embodiment of the present invention (EMBODIMENT 2), as illustrated in FIG. 2, the printhead structure (106) and the toner container (101) are built together to form a toner application module. Via a gas inlet (111) in a gas expansion chamber (113), at the bottom of the toner container, gas permeates a porous plate (114), forming the bottom of the toner container (101) and creates in the container a fluidized bed forming a toner cloud (100) of toner particles. In the toner container (101), one or more coronas (115) may be present to charge the toner particles in the fluidized bed. Instead of corona's other known charge injection means as e.g. static or rotating blades with sharp edges can be used. The toner used can be replaced in toner container (101) via a toner inlet (116) that is connected with a reservoir of toner (not shown in FIG. 2).

Figure 4:
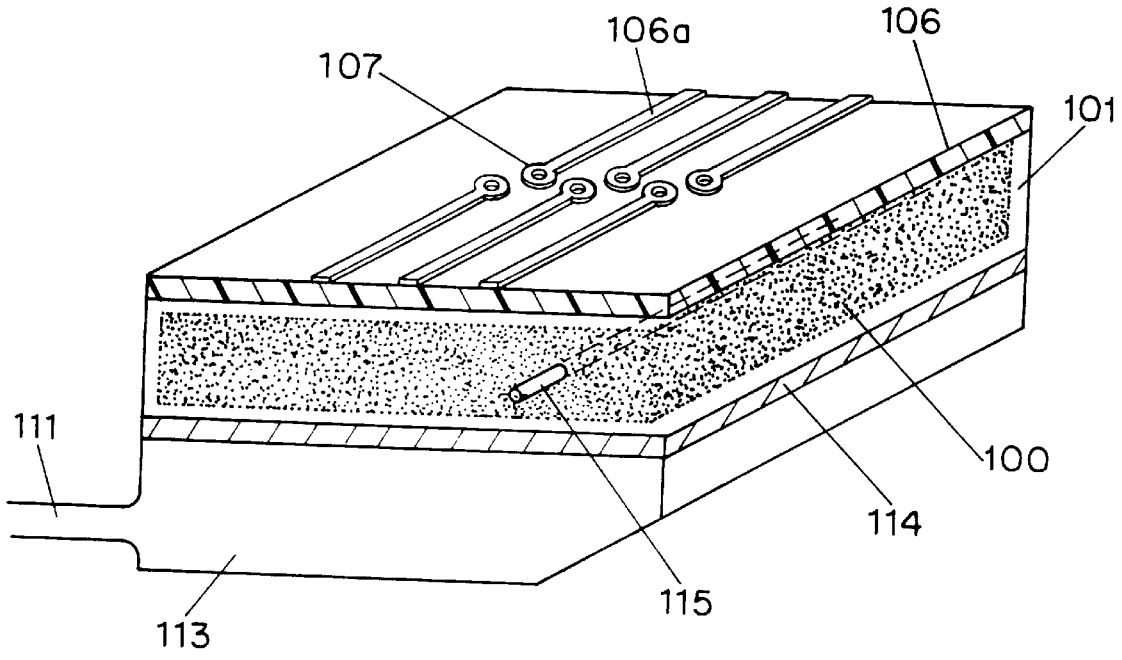

When the printhead structure (106) and the toner container (101) are built together to form a toner application module as shown in FIG. 2 it is not necessary to provide an inlet (116) for toner replenishment. In such a case, where no toner inlet (116) is provided when all toner comprised in toner container (101) is used the complete module is replaced. Such a replaceable module is depicted in FIG. 4. This has the advantage that for each new toner load, a new printhead structure is used. This diminishes (or even excludes) the need for more or less complicated means for cleaning the printhead structure, as were needed in prior art DEP devices.

The porous plate (114) can be made from any material known in the art, e.g., porous stainless steel or porous glass as normally used in filtration applications. The dimensions of the pores are chosen as a function of the diameter of the toner, the specific gravity of the toner, the dimensions of the toner container, etc to ensure an adequate formation of the fluidized bed. Typical, preferred values for the dimensions of the pores are diameters between 0.05 and 0.5 $\mu$m.

Figure 3:
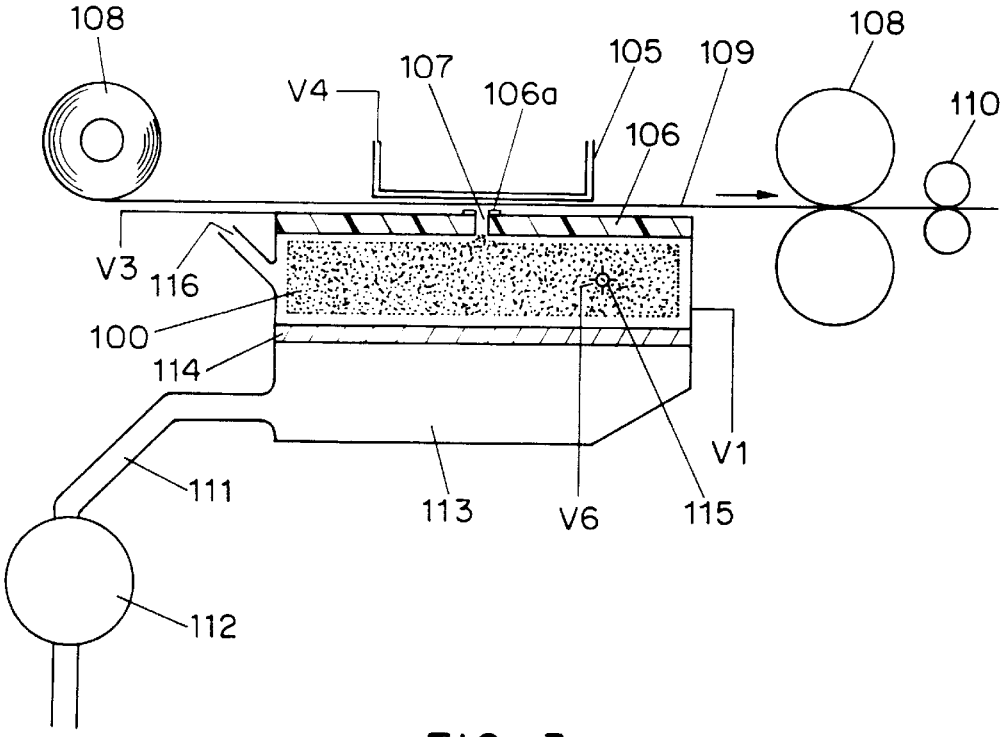
FIG. 3 shows a schematic illustration of a DEP device using a toner supply module as shown in FIG. 2.

In FIG. 3 it is schematically shown how a toner application module as shown in FIG. 2 can be implemented in a DEP device. In this figure a printhead structure (106) is shown having control electrodes (106*a*) on a polymeric material around printing apertures (107), said control electrodes facing away from the toner cloud (100) in the fluidized bed contained in toner container (101). The printhead structure does not comprise a shield electrode. From the fluidized bed (toner cloud (100)), toner particles in the neighbourhood of the printing apertures (107) can be attracted to the receiving substrate (109) that is transported, by transporting means (108), between the printhead structure (106), and a back electrode (105) in the direction of arrow A. The image is fixed to the substrate (109) by fixing means (110). When using non magnetic toner particles, it is possible to charge the toner particles in the fluidized bed by means of corona wire(s) (115) (other charge injecting means can replace the corona wires, e.g. static or rotating blades with sharp edges). The toner used during printing is replenished via opening (116) that is connected to a toner reservoir (not shown) The fluidized bed is formed by a gas stream entering gas expansion chamber (113) via gas inlet (111). The gas stream is controlled by control means (112) and passes via porous plate (114) to form the cloud of toner particles (fluidized bed) (100) in toner container (101).

Control electrode (106*a*) on the printhead structure makes it possible to have toner imagewise passing the apertures (107). Between said printhead structure (106) and the toner container (101) as well as between the control electrode around the apertures (107) and the back electrode (105) behind the toner receiving member (109) as well as on the single electrode surface different electrical fields are applied. In the specific embodiment of a device (EMBODIMENT 2), useful for a DEP method, according to the present invention, shown in FIG. 3, voltage V1 is applied to the walls of toner container (101), (these walls are isolated from the control electrodes on printhead structure (106) by the polymeric film comprised in the printhead structure), voltages $\mathbf{V3}_0$ up to $\mathbf{V3}_n$ for the control electrode (106*a*). The value of V3 is selected, according to the modulation of the image forming signals, between the values $\mathbf{V3}_0$ and $\mathbf{V3}_n$, on a timebasis or grey-level basis. Voltage V4 is applied to the back electrode behind the toner receiving member. In other embodiments of the present invention multiple voltages $\mathbf{V2}_0$ to $\mathbf{V2}_n$ and/or $\mathbf{V4}_0$ to $\mathbf{V4}_n$ can be used. Voltage V6 is applied to the corona wire(s) (115) to charge the toner particles in the toner container (fluidized bed).

An overview of fluidized bed technology can be found in e.g. Encyclopedia of Chemical Technology, Kirk-Othmer, Fourth edition volume 11, pages 138 through 170, Wiley and sons N.Y., 1994, ISBN 0-471-52680-0 (v.11) and in the references contained therein.

The use of fluidized bed in connection with toner particles has been described in, e.g., EP-A 618 510 where it is disclosed that conductive, rounded toner particles can be produced in a fluidized bed of toner particles and in, e.g. EP-A 494 454, EP-A 620 505 or DE 32 13 314 A1, where the use of toner in fluidized bed in classical electro(photo) graphy is disclosed. In U.S. Pat. No. 4,777,106 it is also disclosed that toner particles can be brought on to a application roller from a fluidized bed. From said roller the toner particles are further used to develop a latent electrostatic image (formed by ion injection on a dielectric cylinder), that is transferred on a final substrate. The combination of toner cloud formation in a fluidized bed and direct electrostatic printing (DEP) further simplifies the DEP method, by dispensing of electrical or mechanical means for providing a toner mist and by providing a DEP apparatus with less moving parts.

The gas for formation of the fluidized bed can be any gas, but again air and nitrogen are preferred according to the present invention. The module, as shown in FIG. 2 and FIG. 3, has only one gas inlet (111). It is however possible to construct a module that basically equals the module shown in FIG. 2 and FIG. 3, but having more than one gas inlet. When two gas inlets are present it is preferred that both inlets are located opposite to each other. Also in this embodiment it possible to install control means (112) on both gas inlets and by appropriate timing means, installed on control means (112), to have either continuous or pulsating air streams. The pulsation of the air streams can be independently adjusted to the desired value. The pulsation of the gas streams from outlet (111*a*) and (111*b*) can be alternated, i.e. when gas is passed to the toner particles from outlet (111*a*), outlet (111*b*) is closed and vice-versa. Said gas (air) streams are preferably pulsated at a frequency between 10 and 200 Hz. The gas stream(s) has (have) a pressure of at least 1 $10^5$ Pa.

The gas inlet or inlets at the bottom of the module of EMBODIMENT 2 can have any shape, the walls of the module can comprise means to optimize the particles flow in the gas stream.

It is possible to implement a toner application module as shown in FIG. 2 where the printhead structure is made of isolating material comprising on one side individual control electrodes and on the other side a continuous shield electrode facing e.g. the toner container (101). In that case it is preferred that the walls of the toner container are isolated from the shield electrode and a separate voltage is applied to the shield electrode. Also embodiment 2 of the present invention can be implemented by using be a so called matrix electrode, being a mesh of woven electrical conductors, as described in e.g. EP-B 390 847 and EP-B 476 030.

In EMBODIMENT 2 a mono-component developer comprising non-magnetic toner particles can be used. The charging of this toner particles can proceed by simple frictional contact between the particles, the wall of toner container (101) and the gas. The charging can be helped by using ionized air as gas stream for forming the fluidized bed. The air can be ionized by any means known in the art, e.g. corona wires are very suitable for ionizing the air. In the case of using non-magnetic monocomponent developers in a fluidized bed as exemplified in EMBODIMENT 2 of the present invention, it may be beneficial to mix larger non-conductive particles, that in contact with the toner particles can impart a charge to the toner particles (charge injecting beads). The addition of such particles, having preferably an average diameter between 20 and 100 $\mu$m, more preferably between 40 and 80 $\mu$m, makes both the formation of the fluidized bed and the charging of the toner particles easier. These additional particles can be carrier particles as used in well known multi-component developers.

The toner particles will preferably have an average volume diameter ($d_{v50}$) between 3 and 25 $\mu$m, preferably between 5 and 20 $\mu$m and the particles size distribution is preferably narrow. The coefficient of variability, $\nu$, (i.e. the standard deviation of the distribution/$d_{v50}$) of the volume distribution is preferably lower than 0.33, more preferably lower than 0.25.

Also toner particles suitable for use in the present invention are described in the above mentioned EP-A 675 417. Very suitable toner particles, for use in combination with a printhead structure according to the present invention are toner particles, having a well defined degree of roundness. Such toner particles have been described in detail in EP-A 715 218, that is incorporated herein by reference.

A DEP device, according to the present invention using a toner cloud being formed by a stream of gas, can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage $V_3$ applied on the control electrode (106*a*) or by a time modulation of $V_3$. By changing the duty cycle of the time modulation at a specific frequency, it is possible to print accurately fine differences in grey levels. It is also possible to control the grey level printing by a combination of an amplitude modulation and a time modulation of the voltage $V_3$, applied on the control electrode.

Multilevel halftoning techniques, such as e.g. described in EP-A 634 862. The screening method for a rendering device having restricted density resolution, disclosed in that document can be used for a DEP device according to the present invention. This enables the DEP device, according to the present invention, to render high quality images.

Several DEP devices, incorporating the formation of a toner cloud by a gas stream as disclosed in the present invention, (each having a toner with a different colour) can, as is the case with any DEP device or in fact with any printing device (e.g. ink-jet printing devices, modules applying toner to an electrostatic latent image, etc), be combined in a single apparatus, making it possible to obtain a colour-printer yielding high quality images. These DEP devices can be incorporated in such a single apparatus in line, in a circle, etc in the vicinity of an image receiving substrate in such a way that colour images are applied in register to said substrate. The DEP devices can be ordered along to sides of a web of image receiving substrate in such a way that on both sides of said image receiving substrate colour images are formed in register in one pass. A possible embodiment of positioning DEP devices in the vicinity of an image receiving member can be derived from e.g. U.S. Pat. No. 5,173,735 directed to electrophotography. It is possible to replace the toner applying modules by DEP devices and the electrophotosensitive drum by an intermediate image receiving substrate. Printing of colour images with very good register quality can be achieved with e.g. register control means comprising an encoder driven by the displacement of the image receiving substrate (in web form). The encoder can e.g. be mounted on one of the rotating intermediate image receiving members. This encoder produces pulses indicative of the web displacement. By this means the moving web can accurately be synchronized with rotating intermediate image receiving members on which the separate colour images (the colour separations yellow, magenta, cyan and optionally black) are applied by different DEP devices. It is also possible to use different DEP devices that deposit toner images directly to an image receiving substrate in web form. In that case the web velocity is accurately registered with auxiliary devices. Embodiments of colour printing apparatus, printing on material (substrates) in web form and using register control means, are disclosed in e.g. EP-A 629 924, EP-A 629 927 and EP 631 204. The apparatus, disclosed in the documents cited above, are designed as classical electrophotographic apparatus, but can be changed to printing apparatus using DEP devices. The colour printing using different DEP devices, can proceed on image receiving substrates in web or sheet form. A colour printing apparatus using registering means and printing on sheet material is e.g. disclosed in U.S. Pat. No. 5,119,128.

The combination of a final image receiving substrate in web form, accurate registration of colour separations, measurement of web velocity and changes in web velocity, the placement of several DEP devices (several DEP devices can be placed in such a way that printing on both sides of the web in one pass is possible) open the way for colour printing devices based on DEP (direct electrostatic printing) using receiving members in web form. After printing the web can be wound up again or can immediately after printing be cut into sheets. In this way colour printing apparatus, based upon a DEP technique, with very good image quality can be made. These apparatus can be adapted for printing of very small items (e.g. ID-cards, security printing, etc) as well as for printing very large surfaces (e.g. poster or sign printing).

It can be advantageous to combine a DEP device, according to the present invention, in one apparatus together with a classical electrographic or electrophotographic device, in which a latent electrostatic image on a charge retentive surface is developed by a suitable material to make the latent image visible. In such an apparatus, the DEP device according to the present invention and the classical electrographic device are two different printing devices. Both may print images with various grey levels and alphanumeric symbols and/or lines on one sheet or substrate. In such an apparatus the DEP device according to the present invention can be used to print fine tuned grey levels (e.g. pictures, photographs, medical images etc. that contain fine grey levels) and the classical electrographic device can be used to print alphanumeric symbols, line work etc. Such graphics do not need the fine tuning of grey levels. In such an apparatus—combining a DEP device, according to the invention with a classical electrographic device—the strengths of both printing methods are combined.

EXAMPLES

The DEP Device Used Throughout the Examples

In each example the same DEP device, as shown in FIG. 1, using the same toner particles and carrier particles was used. The gas used was air. In the different examples only the air pressure and pulsation of the air stream has been changed.

The toner delivery means was a charged toner conveyor supplied with charged toner particles from a stationary core/rotating sleeve type magnetic brush. The development assembly comprised two mixing rods and one metering roller. One rod was used to transport the developer through the unit, the other one to mix toner with developer.

The magnetic brush assembly (104) was constituted of the so called magnetic roller, which in this case contained inside the roller assembly a stationary magnetic core, showing nine magnetic poles of 500 Gauss magnetic field intensity and with an open position to enable used developer to fall off from the magnetic roller. The magnetic roller contained also a sleeve, fitting around said stationary magnetic core, and giving to the magnetic brush assembly an overall diameter of 20 mm. The sleeve was made of stainless steel roughened with a fine grain to assist in transport (Ra=3 $\mu$m).

A scraper blade was used to force developer to leave the magnetic roller. And on the other side a doctoring blade was used to meter a small amount of developer onto the surface of said magnetic brush assembly. The sleeve was rotating at 100 rpm, the internal elements rotating at such a speed as to conform to a good internal transport within the development unit. The magnetic brush assembly (104) was connected to a DC-power supply with -200V (this is the $V_2$, referred to hereinabove in the description of FIG. 1). Said magnetic brush was located at 650 micron from the surface of a teflon coated aluminium charged toner conveyor (103) with a diameter of 40 mm. The sleeve of said charged toner conveyor was connected to an AC power supply with a square wave oscillating field of 600 V at a frequency of 3.0 kHz with 10 V DC-offset (this 10 V DC are the $V_1$, referred to hereinabove in the description of FIG. 1).

The back electrode (105) was held at 600 V DC (this is $V_4$, referred to hereinabove in the description of FIG. 1).

A macroscopic "soft" ferrite carrier consisting of a MgZn-ferrite with average particle size 50 $\mu$m, a magnetisation at saturation of 29 emu/g (36 $\mu Tm^3/kg$) was provided with a 1 $\mu$m thick acrylic coating. The material showed virtually no remanence.

The toner used for the experiment had the following composition: 97 parts of a co-polyester resin of fumaric acid and propoxylated bisphenol A, having an acid value of 18 and volume resistivity of $5.1\times10^{16}$ Ω.cm was melt-blended for 30 minutes at 110° C. in a laboratory kneader with 3 parts of Cu-phthalocyanine pigment (Colour Index PB 15:3). A resistivity decreasing substance—having the following structural formula: $(CH_3)_3N^+C_{16}H_{33}Br^-$ was added in a quantity of 0.5% with respect to the binder. It was found that—by mixing with 5% of said ammonium salt—the volume resistivity of the applied binder resin was lowered to $5\times10^{14}$ Ω.cm. This proves a high resistivity decreasing capacity (reduction factor: 100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner, measured by Coulter Counter model Multisizer (tradename), was found to be 6.3 $\mu$m average by number and 8.2 $\mu$m average by volume. In order to improve the flowability of the toner mass, the toner particles were mixed with 0.5% of hydrophobic colloidal silica particles (BET-value 130 $m^2/g$).

An electrostatographic developer was prepared by mixing said mixture of toner particles and colloidal silica in a 10% ratio by weight (w/w) with carrier particles.

The distance between the front side of the printhead structure (106) and the sleeve of the charged toner conveyor (103), was set at 400 $\mu$m. The distance between the surface of said charged toner conveyor (103) and the sleeve of the magnetic brush (104), was set at 650 $\mu$m. The distance between the support for the image receiving substrate (105)

(in the example said support combines the supporting function with the function of back electrode) and the back side of the printhead structure (106) (i.e. control electrodes (106*a*)) was set to 150 $\mu$m and the paper travelled at 1 cm/sec.

Measurement A: Measurement of Printing Quality

Using a DEP device as shown in FIG. 1, prints were made of patches of even density, using the air stream characteristics as shown in table 1. The homogeneity of the printing was measured by having the printed even density scanned by a line scanning densitometer over a distance of 1 cm. The value of the largest deviation of the average density ($\Delta D$) over the average density (D) is calculated and the given the values:

1 for $\Delta D/D \leqq 0.40$ 2 for $\Delta D/D \leqq 0.20$ 3 for $\Delta D/D \leqq 0.10$ 4 for $\Delta D/D \leqq 0.05$ wherein a value for $\Delta D/D$ of 0.10 is acceptable. The results of the printing are also given in table 1.

TABLE 1

| Number | Pressure* | Pulsation** | Density*** | Evenness† |
|---|---|---|---|---|
| 1 | 0 | none | 0.02 | n.m. |
| 2 | 1.5 | none | 0.74 | 1 |
| 3 | 4 | none | 0.87 | 1 |
| 4 | 4 | 1 Hz | 0.80 | 2 |
| 5 | 4 | 10 Hz | 0.61 | 3 |
| 6 | 0.8 | 10 Hz | 0.06 | n.m. |
| 7 | 4 | 100 Hz | 0.73 | 4 |
| 8 | 4 | 100 Hz†† | 0.91 | 4 |

*in $10^5$ Pa (Bar) appiied to both gasoutlet (111a) and (111b)
**in Hz appiied to both gasoutlet (111a) and (111b)
***average density of an even density patch
†according to measurement A
††alternating between gasoutlet (111a) and (111b)
n.m. : not measured (average density too low)

We claim:

1. A direct electrostatic printing device for printing images onto a receiving substrate, comprising:

a charged toner conveyor for conveying particles of toner, said charged toner conveyor being maintained at a first electrical potential;

a printhead structure having a first side and a second side, said first side being located proximate to said charged toner conveyor, said printhead structure having an array of printing apertures extending therethrough from said first side to said second side, each side printing aperture being surrounded by an addressable control electrode, and each said addressable control electrode being capable of electrically modulating a flow of said particles of toner through the respective printing aperture in a direction away from said charged toner conveyor;

a back electrode maintained at a second electrical potential, said back electrode being located proximate to said second side of said printhead structure and forming therebetween a gap for the receiving substrate, whereby the receiving substrate is located between said back electrode and said printhead structure; and at least one gas outlet located between said charged toner conveyer and said printhead structure for producing a gas stream to detach said particles of toner from said charged toner conveyer and to form a cloud of said particles of toner between said charged toner conveyer and said printhead structure, whereby said printhead structure in combination with said first electrical potential of said charged toner conveyer and said second electrical potential of said back electrode cause said particles of toner to be deposited onto the receiving substrate to form an image.

2. A direct electrostatic printing device according to claim 1, further comprising a plurality of said gas outlets directed toward one another for directing said gas stream toward said particles of toner on said charged toner conveyer.

3. A direct electrostatic printing device according to claim 1, further comprising a means for causing said gas stream to pulsate.

4. A direct electrostatic printing device according to claim 3, wherein said means for causing said gas stream to pulsate is operated to pulsate said gas stream at a frequency of between 5 and 200 Hz.

5. A direct electrostatic printing device according to claim 1, wherein said gas stream has a pressure of at least $1\times10^5$ Pa.

6. A direct electrostatic printing device for printing images onto a receiving substrate, comprising:

a toner container for containing particles of toner, said toner container having an inside and being substantially open at at least one end, said particles of toner being maintained at a first electrical potential;

a printhead structure having a first side and a second side, said first side being located proximate to said open end of said toner container, said printhead structure having an array of printing apertures extending therethrough from said first side to said second side, each said printing aperture being surrounded by an addressable control electrode, and each said addressable control electrode being capable of electrically modulating a flow of said particles of toner through the respective printing aperture in a direction away from said inside of said toner container;

a back electrode and maintained at a second electrical potential, said back electrode being located proximate to said second side of said printhead structure and forming therebetween a gap for the receiving substrate, whereby the receiving substrate is located between said back electrode and said printhead structure; and at least one gas inlet located in said toner container for producing a gas stream in said inside of said toner container to form a cloud of said particles of toner to provide a fluidized bed of said particles of toner proximate to said printhead structure, whereby said printhead structure in combination with said first electrical potential of said particles of toner and said second electrical potential of said back electrode cause said particles of toner to be deposited onto the receiving substrate to form an image.

7. A direct electrostatic printing device according to claim 6, wherein said printhead structure and said toner container are constructed as a unit to form a replaceable toner application module.

8. A direct electrostatic printing device according to claim 6, wherein said gas stream has a pressure of at least $1\times10^5$ Pa.

9. A direct electrostatic printing device according to claim 6, wherein said particles of toner are non-magnetic.

10. A direct electrostatic printing device according to claim 6, further comprising means for electrically charging said particles of toner, said means for electrically charging said particles of toner being at a voltage of between 4 kV and 8 kV.

11. A direct electrostatic printing device according to claim 6, wherein said particles of toner are mixed with charge injecting beads.

12. A direct electrostatic printing device according to claim 6, further comprising two said gas inlets in said toner container, said two gas inlets being arranged to oppose one another.

13. A direct electrostatic printing device according to claim 6, further comprising a means for causing said gas stream to pulsate.

14. A direct electrostatic printing device according to claim 13, wherein said means for causing said gas stream to pulsate is operated to pulsate said gas stream at a frequency of between 5 and 200 Hz.

* * * * *

UNITED STATES PATENT AND TRADEMARK OFFICE

CERTIFICATE OF CORRECTION

PATENT NO. : 5,984,443

DATED : November 16, 1999

INVENTOR(S) : Desie et al.

It is certified that error appears in the above-identified patent and that said Letters Patent is hereby corrected as shown below:

Column 12, line 43, "and" should be deleted.

Signed and Sealed this

Thirtieth Day of January, 2001

*Attest:*

Q. TODD DICKINSON

*Attesting Officer*

*Director of Patents and Trademarks*